US005166129A

United States Patent [19]

Shuttleworth et al.

[11] Patent Number: 5,166,129

[45] Date of Patent: Nov. 24, 1992

[54] BENZOMORPHOLINEPYRROLINE DYE-DONOR ELEMENT FOR THERMAL DYE TRANSFER

[75] Inventors: Leslie Shuttleworth; Helmut Weber, both of Webster, N.Y.

[73] Assignee: Eastman Kodak Company, Rochester, N.Y.

[21] Appl. No.: 716,570

[22] Filed: Jun. 14, 1991

[51] Int. Cl.[5] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS 5,013,710 5/1991 Kanto et al. ..... 503/227

FOREIGN PATENT DOCUMENTS 327063 8/1989 European Pat. Off. ..... 503/227

327077 8/1989 European Pat. Off. ..... 503/227

*Primary Examiner*—B. Hamilton Hess

*Attorney, Agent, or Firm*—Harold E. Cole

[57] ABSTRACT

A dye-donor element for thermal dye transfer comprises a support having thereon a dye dispersed in a polymeric binder, the dye having the formula:

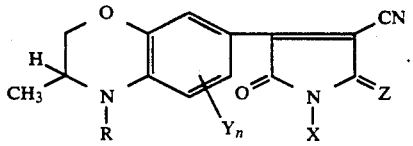

12 Claims, No Drawings

BENZOMORPHOLINEPYRROLINE DYE-DONOR ELEMENT FOR THERMAL DYE TRANSFER

This invention relates to dye-donor elements used in thermal dye transfer which have good hue and dye stability.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of certain dyes in dye-donor elements for thermal dye transfer printing. Many of the dyes proposed for use do not have adequate stability to light. Others do not have good hue. It would be desirable to provide dyes which have good light stability and have improved hues.

Pyrroline dyes for thermal applications have been described in EPA's 327,077 and 327,063. There is a problem with these dyes in that their light stability is not good. It would be desirable to modify these dyes so that they would have improved light stability.

These and other objects are achieved in accordance with this invention which comprises a dye-donor element for thermal dye transfer comprising a support having thereon a dye dispersed in a polymeric binder, the dye having the formula:

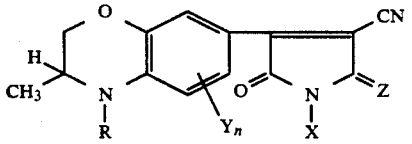

wherein:

R represents hydrogen; a substituted or unsubstituted alkyl group having from 1 to about 8 carbon atoms such as methyl, ethyl, propyl, isopropyl, butyl, pentyl, hexyl, methoxyethyl, benzyl, 2-methane-sulfonylamidoethyl, 2-hydroxyethyl, 2-cyanoethyl, methoxycarbonylmethyl, etc.; a cycloalkyl group having from about 5 to about 8 carbon atoms, such as cyclohexyl, cyclopentyl, etc,; or a substituted or unsubstituted alkenyl group having from about 2 to about 8 carbon atoms, such as $CH_2CH{=}CH_2$, $CH_2CH{=}CHCH{=}CH_2$, $CH_2CH{=}CHCH_2OCH_3$, or $CH_2CH{=}CHC_5H_{11}$;

each Y independently represents hydrogen; a substituted or unsubstituted alkyl group having from 1 to about 8 carbon atoms such as those listed above for R; an alkoxy group such as OR; or halogen such as fluorine, chlorine or bromine;

n is 0 to 3;

Z is O or $C(CN)_2$; and

X is R, a substituted or unsubstituted acyl group having from 2 to about 9 carbon atoms such as

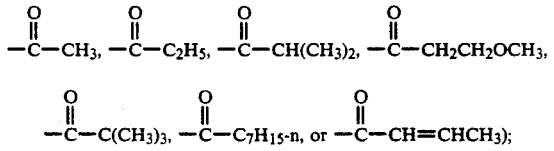

a substituted or unsubstituted aroyl group having from about 7 to about 18 carbon atoms,

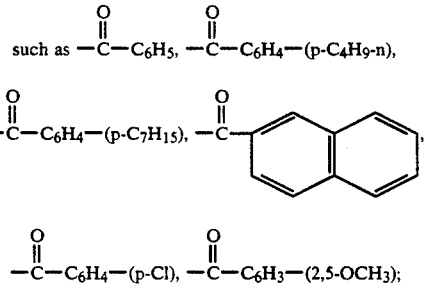

or a substituted or unsubstituted heteroaroyl group having from about 2 to about 10 carbon atoms, such as

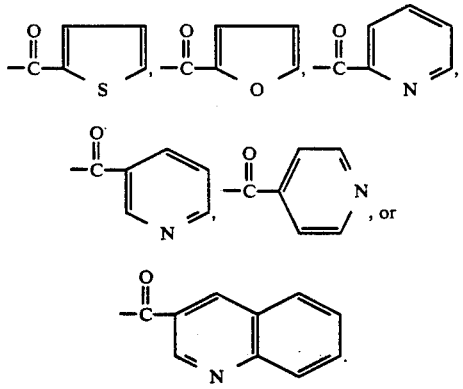

In a preferred embodiment of the invention, R is $CH_2CH_2C_6H_5$, X is $CH_2CH{=}CH_2$, Y is H and Z is O. In another preferred embodiment, R is $C_5H_{11}$-n, $CH_2CH_2C_6H_5$, $CH_2CH_2O_2CCH_3$ or $CH_2CH_2OH$; X is H, $CH_2CH{=}CH_2$ or $CH_2CH_2O_2CCH_3$; Y is H and Z is $C(CN)_2$.

The dyes may be synthesized by the method for tetrahydroquinoline dyes as described in EPA 327,063 and if involving a N-acyl derivative, using the acylation as described in copending U.S. Application Ser. No. 715,775, entitled "Acylated Dicyanovinylpyrroline Dye-Donor Element for Thermal Dye Transfer", by the same inventors, filed Jun. 14, 1991, the disclosure of which is hereby incorporated by reference.

Specific dyes useful in the invention include the following:

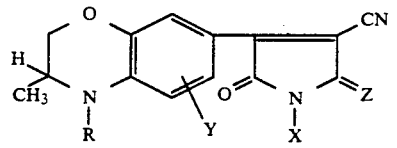

| Dye | R | X | Y | Z |
|---|---|---|---|---|
| 1 | $CH_2CH_2C_6H_5$ | $CH_2CH{=}CH_2$ | H | O |
| 2 | $C_5H_{11}$ | $CH_2CH{=}CH_2$ | H | O |
| 3 | $CH_2CH_2C_6H_5$ | $CH_2C_6H_5$ | H | O |
| 4 | $C_4H_9$-n | $CH_2C_6H_4$(p-Cl) | H | O |
| 5 | $C_5H_{11}$-n | H | H | $C(CN)_2$ |
| 6 | $C_5H_{11}$-n | $CH_2CH{=}CH_2$ | H | $C(CN)_2$ |
| 7 | $CH_2CH_2C_6H_5$ | $CH_2CH{=}CH_2$ | H | $C(CN)_2$ |
| 8 | $CH_2CH_2C_6H_5$ | $CH_2CH_2O_2CCH_3$ | H | $C(CN)_2$ |
| 9 | $CH_2CH_2O_2CCH_3$ | $CH_2CH{=}CH_2$ | H | $C(CN)_2$ |
| 10 | $CH_2CH_2OH$ | $CH_2CH{=}CH_2$ | H | $C(CN)_2$ |
| 11 | $CH_2CH_2C_6H_5$ | H | H | $C(CN)_2$ |
| 12 | $C_2H_5$ | $CH_2C_6H_5$ | H | $C(CN)_2$ |
| 13 | $CH_2C_6H_5$ | $C_4H_9$-n | H | $C(CN)_2$ |
| 14 | $C_4H_9$-n | $COC_2H_5$ | 7-$OC_2H_5$ | $C(CN)_2$ |
| 15 | $CH_3$ | $COC_6H_5$ | 8-$C_2H_4OH$ | $C(CN)_2$ |
| 16 | $C_2H_4CN$ | $COC_7H_{15}$-n | 7-$C_5H_{11}$—C | $C(CN)_2$ |

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye in the dye-donor element of the invention is dispersed in a polymeric binder such as a cellulose derivatives, e.g., cellulose acetate hydrogen phthalate, cellulose acetate, cellulose acetate propionate, cellulose acetate butyrate, cellulose triacetate or any of the materials described in U.S. Pat. No. 4,700,207 of Vanier and Lum; a polycarbonate; poly(styrene-co-acrylonitrile), a poly(sulfone) or a poly(phenylene oxide). The binder may be used at a coverage of from about 0.1 to about 5 $g/m^2$.

The dye layer of the dye-donor element may be coated on the support or printed thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polymides such as polymide-amides and polyetherimides. The support generally has a thickness of from about 2 to about 30 μm. It may also be coated with a subbing layer, if desired, such as those materials described in U.S. Pat. Nos. 4,695,288 and 4,737,486.

The reverse side of the dye-donor element may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711, 4,717,712, 4,737,485, 4,738,950, and 4,829,050. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$. If a polymeric binder is employed, the lubricating material is present in the range of 0.001 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polymide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as DuPont Tyvek ®.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 $g/m^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only the dye thereon as described above or may have alternating areas of other different dyes, such as sublimable cyan and/or magenta and/or yellow and/or black or other dyes. Such dyes are disclosed in U.S. Pat. Nos. 4,541,830, 4,698,651, 4,695,287, 4,701,439, 4,757,046, 4,743,582, 4,769,360, and 4,753,922; the disclosures of which are hereby incorporated by reference. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of yellow, and a cyan and/or magenta dye as described above, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-A040MCSOO1), a TDK Thermal Head F415 HH7-1089 or a Rohm Thermal Head KE 2008-F3.

A thermal dye transfer assemblage of the invention comprises:

(a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

A magenta dye-donor element was prepared by coating the following layers in the order recited on a 6 μm poly(ethylene terephthalate) support:

1) Subbing layer of DuPont Tyzor TBT® titanium tetra-n-butoxide (0.17 g/m$^2$) coated from a n-butyl alcohol and n-propyl acetate solvent mixture, and 2) Dye layer containing the magenta dye identified below and illustrated above (0.15 g/m$^2$) and Fluorad FC-431® dispersing agent (3M Company) (0.02 g/m$^2$) in a cellulose acetate propionate (2.5% acetyl, 48% propionyl) binder (0.39 g/m$^2$) coated from a cyclopentanone, toluene, and methanol solvent mixture.

On the back side of the donor was coated a subbing layer 1) as above, and a slipping layer of Emralon 329® dry film poly(tetrafluoroethylene) lubricant (Acheon Colloids) (0.65 g/m$^2$) and carnauba wax (0.017 g/m$^2$) from a toluene, n-propyl acetate, 2-propanol and 1-butanol solvent mixture.

Control magenta dye-donor elements were prepared as described above but with the control dyes below which are dihydro- or tetrahydro-quinoline dyes (0.030 mmoles dye/m$^2$, 0.13–0.14 g/m$^2$) and the binder at 2.6 times the weight of the dye. Structurally, Control Dye C-1 is the closest to Invention Dye 1.

C-1

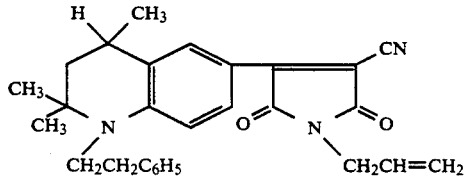

C-2

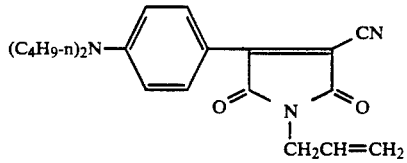

C-3

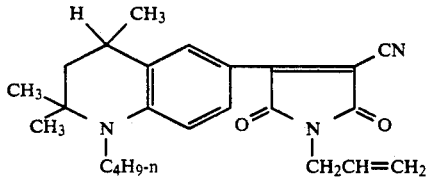

C-4

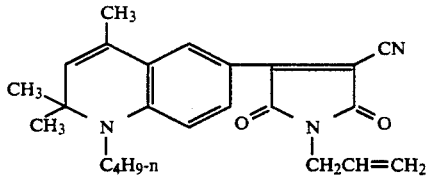

A dye-receiving element was prepared by coating a mixture of Makrolon 5705® (Bayer AG Corporation) polycarbonate resin (2.9 g/m$^2$) and TonePCL-300® polycaprolactone (Union Carbide Co.) (0.8 g/m$^2$) in dichloromethane on a titanium dioxide pigmented polyethylene-overcoated paper stock.

The dye side of the dye-donor element strip approximately 10 cm × 13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 36 Newtons against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed at 29 μsec/pulse at 128 μsec intervals during the 33 μsec/dot printing time. The voltage supplied to the print head was approximately 25 volts, resulting in an instantaneous peak power of 8.1 mjoules/dot. A stepped density image was generated by incrementally increasing the number of pulses/dot from 0 to 255.

The dye-receiving element was separated from the dye-donor element. The Status A Green reflection densities of each stepped image consisting of a series of 11 graduated density steps, each one a cm square, were read.

The images were then subjected to "High-Intensity Daylight" fading for 2 days, 50 klux, 5400° K., 32° C., approximately 25% RH and the densities were reread. The percent density loss was calculated at a density of approximately 1.0. The λ-max (absorption maxima) of each dye in an acetone solution was also determined. The following results were obtained:

TABLE 1

| Dye | λ max (nm) | Status A Green Transferred Density Initial | % Density Loss |
|---|---|---|---|
| 1 | 549 | 1.1 | 26 |
| C-1 Control) | 549 | 1.1 | 68 |
| C-2 Control) | 539 | 1.1 | 37 |
| C-3 Control) | 553 | 1.1 | 50 |
| C-4 (Control) | 569 | 1.0 | 36 |

The above results show the lower light fade of the invention magenta dye as compared to the controls.

EXAMPLE 2

Cyan dye-donor elements were prepared as described in Example 1 except in place of the magenta dye, the cyan dyes identified below and in Table 2 were substituted (0.16 g/m$^2$) and the binder was adjusted to 0.42 g/m$^2$.

Control cyan dye-donors were prepared as described in Example 1 using the following cyan dyes (0.30 mmoles/m$^2$, 0.15–0.17 g/m$^2$):

C-5

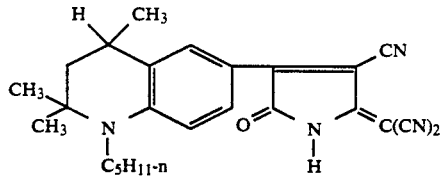

C-6

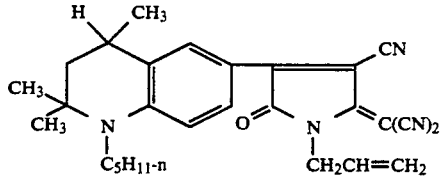

C-7

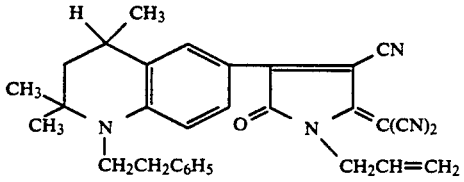

-continued

C-8

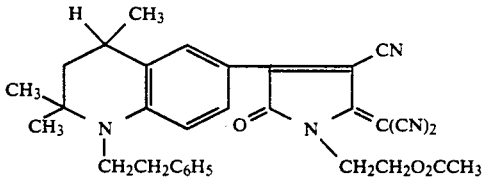

C-9

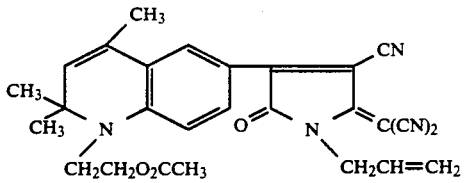

C-10

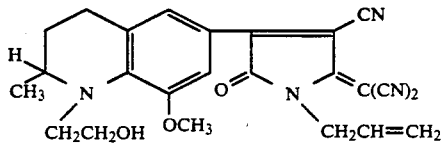

C-11

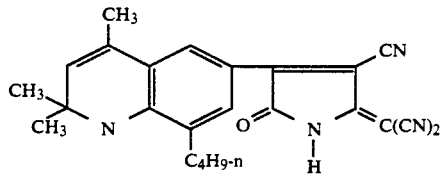

C-12

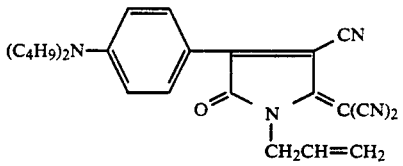

Dye receivers were prepared as described in Example 1.

The same printing and light-fade procedures were used as described in Example 1 except Status A Red reflection densities were read. The following results were obtained:

TABLE 2

| Dye | λ max (nm) | Status A Red Transferred Density Initial | % Density Loss |
|---|---|---|---|
| 5 | 639 | 1.0 | 11 |
| C-5 (Control) | 644 | 1.1 | 12 |
| 6 | 656 | 0.9 | 16 |
| C-6 (Control) | 658 | 1.0 | 37 |
| 7 | 652 | 1.2 | 12 |
| C-7 (Control) | 651 | 1.0 | 32 |
| 8 | 651 | 1.0 | 10 |
| C-8 (Control) | 654 | 1.1 | 16 |
| 9 | 637 | 1.1 | 12 |
| C-9 (Control) | 650 | 1.1 | 39 |
| 10 | 653 | 1.1 | 14 |
| C-10 (Control) | 693 | 0.8 | 16 |
| C-11 (Control) | 657 | 1.0 | 13 |
| C-12 (Control) | 636 | 1.2 | 21 |

The above results indicate the lower fade of the invention cyan dyes as compared to the structurally closest control dyes.

The invention has been described in detail with particular reference to preferred embodiments thereof, but it will be understood that variations and modifications can be effected within the spirit and scope of the invention.

We claim:

1. A dye donor element for thermal dye transfer comprising a support having thereon a dye in a polymeric binder, said dye having the formula:

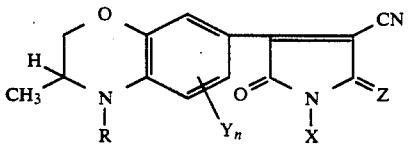

wherein:

R represents hydrogen; a substituted or unsubstituted alkyl group having from 1 to about 8 carbon atoms; a cycloalkyl group having from about 5 to about 8 carbon atoms; or a substituted or unsubstituted alkenyl group having from about 2 to about 8 carbon atoms;

each Y independently represents hydrogen; a substituted or unsubstituted alkyl group having from 1 to about 8 carbon atoms; an alkoxy group OR; or halogen;

n is 0 to 3;

Z is O or $C(CN)_2$; and

X is R; a substituted or unsubstituted acyl group having from 2 to about 9 carbon atoms; a substituted or unsubstituted aroyl group having from about 7 to about 18 carbon atoms; or a substituted or unsubstituted heteroaroyl group having from about 2 to about 10 carbon atoms.

2. The element of claim 1 wherein R is $CH_2CH_2C_6H_5$, X is $CH_2CH{=}CH_2$, Y is H and Z is O.

3. The element of claim 1 wherein R is $C_5H_{11}$-n, $CH_2CH_2C_6H_5$, $CH_2CH_2O_2CCH_3$ or $CH_2CH_2OH$; X is H, $CH_2CH{=}CH_2$ or $CH_2CH_2O_2CCH_3$; Y is H and Z is $C(CN)_2$.

4. The element of claim 1 wherein said support comprises poly(ethylene terephthalate) and the side of the support opposite the side having thereon said dye layer is coated with a slipping layer comprising a lubricating material.

5. The element of claim 1 wherein said dye layer comprises repeating areas of yellow, cyan and magenta dye, said cyan and/or said magenta dye having the formula as specified.

6. In a process of forming a dye transfer image comprising imagewise-heating a dye donor element comprising a support having thereon a dye layer comprising a dye dispersed in a polymeric binder and transferring a dye image to a dye-receiving element to form said dye transfer image, the improvement wherein said dye has the formula:

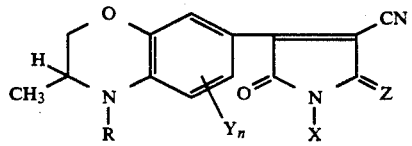

wherein:

R represents hydrogen; a substituted or unsubstituted alkyl group having from 1 to about 8 carbon atoms; a cycloalkyl group having from about 5 to about 8 carbon atoms; or a substituted or unsubstituted alkenyl group having from about 2 to about 8 carbon atoms;

each Y independently represents hydrogen; a substituted or unsubstituted alkyl group having from 1 to about 8 carbon atoms; an alkoxy group OR; or halogen;

n is 0 to 3;

Z is O or $C(CN)_2$; and

X is R; a substituted or unsubstituted acyl group having from 2 to about 9 carbon atoms; a substituted or unsubstituted aroyl group having from about 7 to about 18 carbon atoms; or a substituted or unsubstituted heteroaroyl group having from about 2 to about 10 carbon atoms.

7. The process of claim 6 wherein R is $CH_2CH_2C_6H_5$, X is $CH_2CH{=}CH_2$, Y is H and Z is O.

8. The process of claim 6 wherein R is $C_5H_{11}$-n, $CH_2CH_2C_6H_5$, $CH_2CH_2O_2CCH_3$ or $CH_2CH_2OH$; X is H, $CH_2CH{=}CH_2$ or $CH_2CH_2O_2CCH_3$; Y is H and Z is $C(CN)_2$.

9. The process of claim 6 wherein said support is poly(ethylene terephthalate) which is coated with sequential repeating areas of yellow, cyan and magenta dye, said cyan and/or said magenta dye having the formula as specified, and said process steps are sequentially performed for each color to obtain a three-color dye transfer image.

10. In a thermal dye transfer assemblage comprising:

(a) a dye donor element comprising a support having thereon a dye layer comprising a dye dispersed in a polymeric binder, and (b) a dye-receiving element comprising a support having thereon a dye image-receiving layer, said dye-receiving element being in superposed relationship with said dye-donor element so that said dye layer is in contact with said dye image-receiving layer, the improvement wherein said dye has the formula:

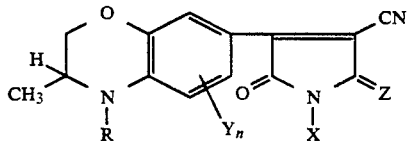

wherein:

R represents hydrogen; a substituted or unsubstituted alkyl group having from 1 to about 8 carbon atoms; a cycloalkyl group having from about 5 to about 8 carbon atoms; or a substituted or unsubstituted alkenyl group having from about 2 to about 8 carbon atoms;

each Y independently represents hydrogen; a substituted or unsubstituted alkyl group having from 1 to about 8 carbon atoms; an alkoxy group OR; or halogen;

n is 0 to 3;

Z is O or $C(CN)_2$; and

X is R; a substituted or unsubstituted acyl group having from 2 to about 9 carbon atoms; a substituted or unsubstituted aroyl group having from about 7 to about 18 carbon atoms; or a substituted or unsubstituted heteroaroyl group having from about 2 to about 10 carbon atoms.

11. The assemblage of claim 10 wherein R is $CH_2CH_2C_6H_5$, X is $CH_2CH{=}CH_2$, Y is H and Z is O.

12. The assemblage of claim 10 wherein R is $C_5H_{11}$-n, $CH_2CH_2C_6H_5$, $CH_2CH_2O_2CCH_3$ or $CH_2CH_2OH$; X is H, $CH_2CH{=}CH_2$ or $CH_2CH_2O_2CCH_3$; Y is H and Z is $C(CN)_2$.

* * * * *